US006805264B2

(12) United States Patent
Houvras

(10) Patent No.: US 6,805,264 B2
(45) Date of Patent: Oct. 19, 2004

(54) HYGIENIC SOLUTION DISPENSER

(76) Inventor: Nick Houvras, 7355 Camelot Dr., West Bloomfield, MI (US) 48322

( * ) Notice: Subject to any disclaimer, the term of this patent is extended or adjusted under 35 U.S.C. 154(b) by 11 days.

(21) Appl. No.: 10/373,142

(22) Filed: Feb. 24, 2003

(65) Prior Publication Data

US 2003/0160066 A1 Aug. 28, 2003

Related U.S. Application Data

(60) Provisional application No. 60/359,388, filed on Feb. 25, 2002.

(51) Int. Cl.[7] ..... B67D 5/006
(52) U.S. Cl. ..... 222/180; 222/321.7
(58) Field of Search ..... 222/180, 181.3, 222/179.5, 183, 321.7

(56) References Cited

U.S. PATENT DOCUMENTS

| | | | | | |
|---|---|---|---|---|---|
| 1,487,674 | A | * | 3/1924 | Starbird | 248/313 |
| 1,868,135 | A | * | 7/1932 | Bronander | 169/26 |
| 3,533,526 | A | * | 10/1970 | Adell | 215/399 |
| 4,874,113 | A | * | 10/1989 | Schmidt | 222/143 |
| 4,964,543 | A | * | 10/1990 | Scheiber | 222/180 |
| 5,209,377 | A | | 5/1993 | Steiner et al. | 222/189 |
| 5,632,418 | A | * | 5/1997 | Brown | 222/180 |
| D391,430 | S | * | 3/1998 | Schmidt | D6/545 |
| 5,887,759 | A | * | 3/1999 | Ayigbe | 222/192 |
| 5,975,372 | A | * | 11/1999 | Heyn | 222/181.3 |
| 6,092,694 | A | * | 7/2000 | Sadow | 222/78 |
| 6,161,726 | A | | 12/2000 | Parsons et al. | 222/52 |

FOREIGN PATENT DOCUMENTS

| | | | |
|---|---|---|---|
| JP | 09045064 A | 2/1997 | G11B/33/02 |
| JP | 09045067 A | 2/1997 | G11B/33/12 |

* cited by examiner

*Primary Examiner*—Gene Mancene
*Assistant Examiner*—Melvin A. Cartagena
(74) *Attorney, Agent, or Firm*—Gifford, Krass, Groh, Sprinkle, Anderson & Citkowski, P.C.

(57) ABSTRACT

A hygienic solution dispenser includes a reservoir for a hygienic solution. The reservoir has a wallward side and an opening. A tongue extends along the wallward side and is adapted to secure the reservoir to a mounting fixture. The mounting fixture secures the inventive dispenser to a substrate. A valve seals against the reservoir opening. A pressure actuator in mechanical communication with the valve upon activation discharges solution from within the reservoir onto toilet paper or another application medium. A rectangular cross section reservoir affords a thin profile projecting from the substrate. An injection molded thermoplastic preferably forms a reservoir having a tongue integral therewith.

18 Claims, 2 Drawing Sheets

HYGIENIC SOLUTION DISPENSER

RELATED APPLICATION

This application claims priority of U.S. Provisional Patent Application No. 60/359,388 filed Feb. 25, 2002, which is incorporated herein by reference.

FIELD OF THE INVENTION

The present invention relates generally to a hygienic solution dispenser, and in particular to a lavatory dispenser mounted in conjunction with a toilet paper dispenser.

BACKGROUND OF THE INVENTION

Skin inflammation and discomfort is associated with fecal and urinary enzymes associated with inadequate cleaning after defecation. In particular, fecal protease enzymes digest skin proteins resulting in the passage of irritants into the skin and inflammatory reactions. The regular removal of fecal material greatly improves the condition of skin.

Typical wet wipes include a fibrous mat of polymeric material such as polyester or polyethylene and/or natural synthetic fibers of cellulosic material. While conventional wet wipes impregnated with a surfactant or cleaning solution are well suited to remove fecal material, the disposal of such wipes has limited the applications of conventional wet wipes. Thus, there exists a need for a hygienic solution dispenser situated for the application of hygienic solution onto bathroom tissue for the removal of fecal material, and disposal consistent with used bathroom tissue.

SUMMARY OF THE INVENTION

A hygienic solution dispenser includes a reservoir for a hygienic solution. The reservoir has a wallward side and an opening. A tongue extends along the wallward side and is adapted to secure the reservoir to a mounting fixture. The mounting fixture secures the inventive dispenser to a substrate. A valve seals against the reservoir opening. A pressure actuator in mechanical communication with the valve upon activation discharges solution from within the reservoir onto toilet paper or another application medium. A rectangular cross section reservoir affords a thin profile projecting from the substrate. An injection molded thermoplastic preferably forms a reservoir having a tongue integral therewith.

DESCRIPTION OF THE PREFERRED EMBODIMENTS

The present invention has utility in dispensing a hygienic solution onto a sheet derived from a roll of paper towel or roll of toilet paper for the purpose of cleaning an article or a body portion. In those embodiments of the present invention related to a lavatory setting, a particular utility is found in dispensing a hygienic solution onto toilet paper for wiping clean a toilet seat or removing fecal matter retained on an individual's skin following defecation. Suitable hygienic cleaning solutions illustratively include alcohols such as ethanol and isopropanol and aqueous surfactants such as cationic and anionic surfactants. As used herein, a "solution" includes water, alcohols, astringents, rubefacients, biocides and gelled forms thereof. It is further appreciated that a solution according to the present invention also illustratively includes emollients, antioxidants, emulsifiers, stabilizers, colorants, fragrances and gellants. The use of the present invention enhances personal hygiene by removing fecal flora from one's skin and/or preventing skin contact with a biologic covered surface, such as a toilet seat.

Figure 1:
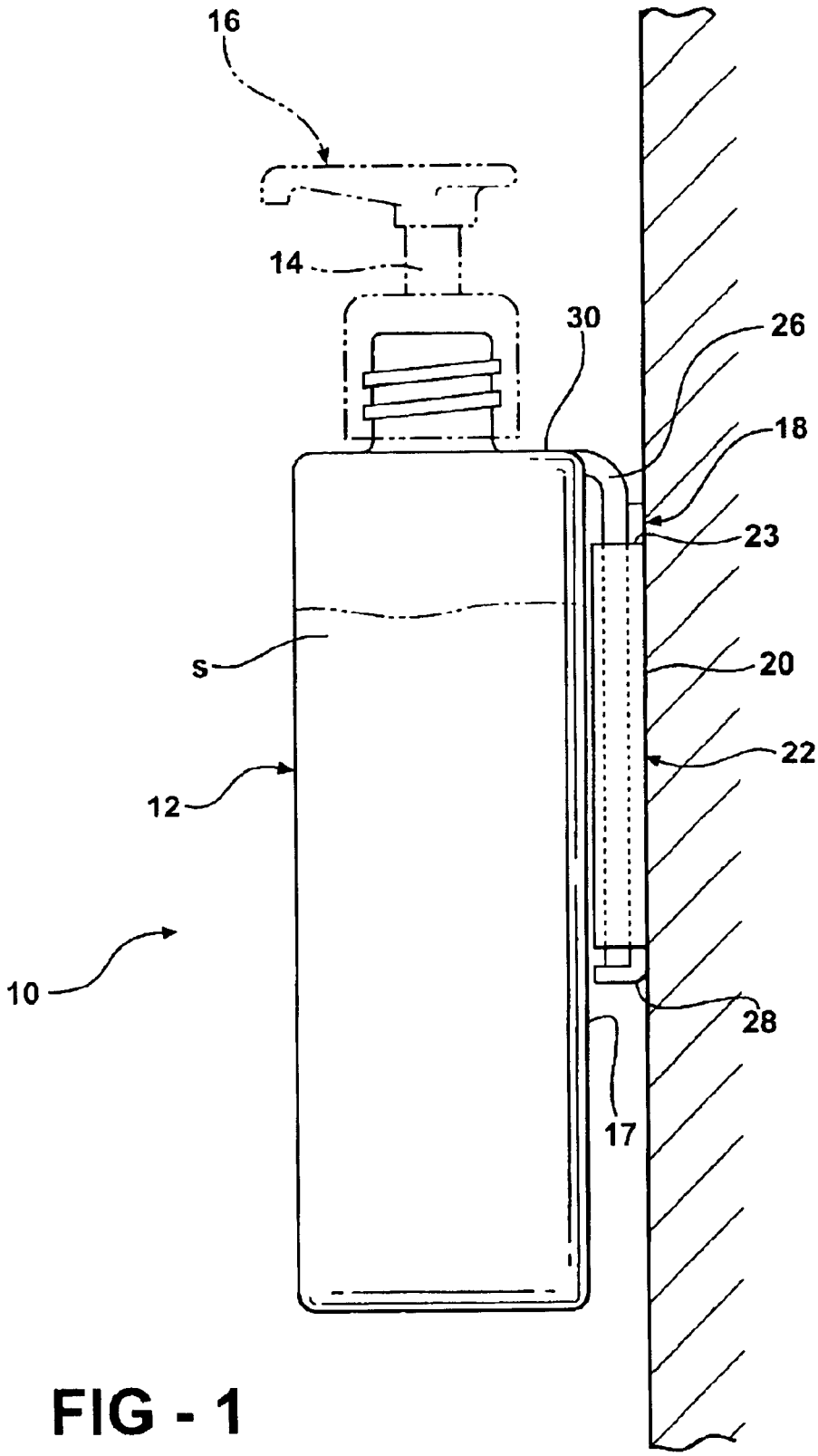
FIG. 1 is a partial cutaway view of a dispenser according to the present invention.
Figure 2:
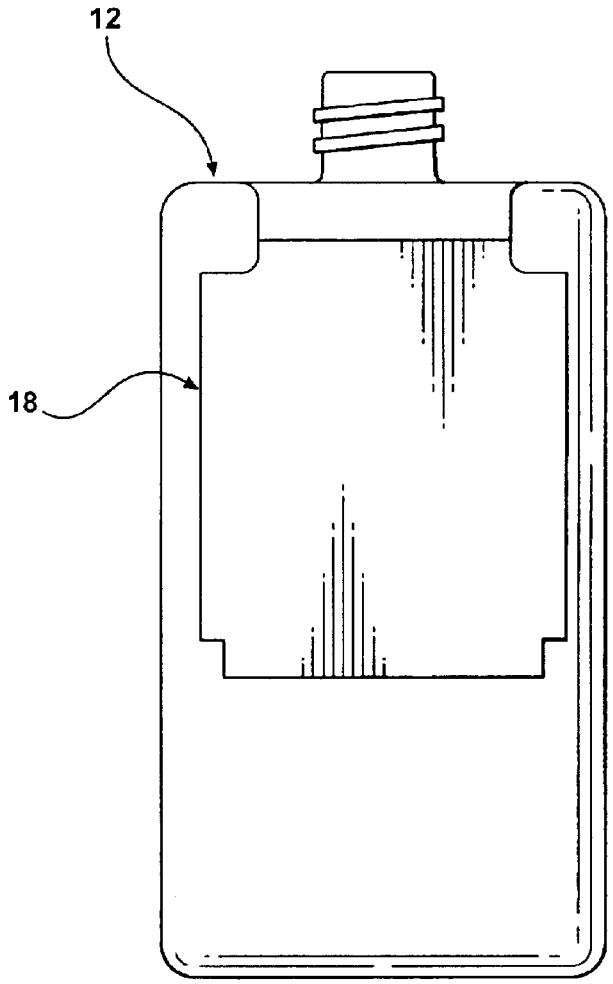
FIG. 2 is a wallward side view of the inventive embodiment depicted in FIG. 1.
Figure 3:
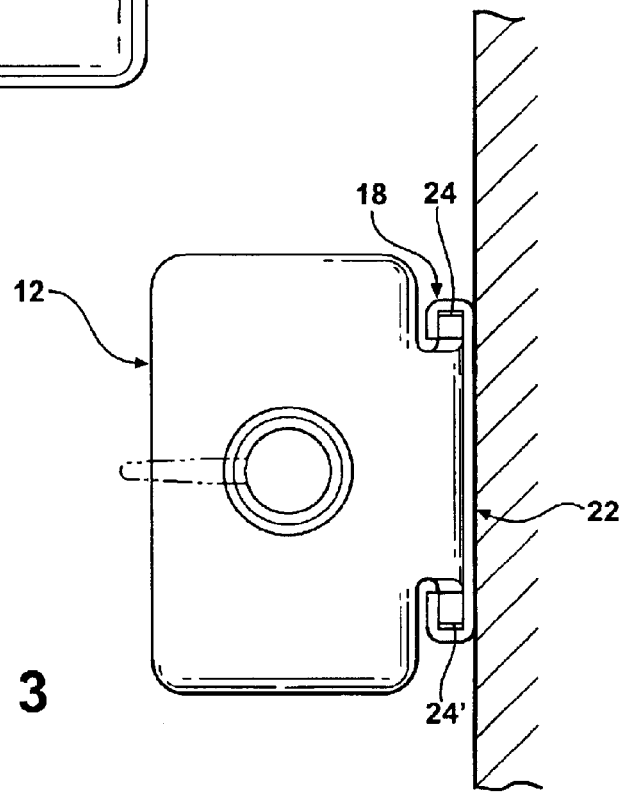
FIG. 3 is a top view of the inventive embodiment depicted in FIG. 1.

Referring now to FIGS. 1–3, an inventive dispenser is shown generally at 10. The dispenser 10 has a reservoir 12 adapted to contain a hygienic skin compatible cleaning solution S. The reservoir 12 terminates in a valve 14 for releasing a quantity of solution S from the reservoir 12 in response to pressure being applied to an actuator 16 in mechanical communication with the valve 14. The valve 14 is appreciated to be of any type conventional to the art illustratively including pump, plunger, stopcock, needle, and diaphragm.

The reservoir 12 has a tongue 26 extending generally parallel to a wallward side 17 thereof. The tongue 26 is preferably injection molded as an integral portion of a thermoplastic reservoir. However, it is appreciated that a sheet metal tongue is readily coupled to a reservoir neck or around the body of a reservoir with a girdling clamp.

Preferably, the reservoir 12 has a rectangular cross section in order to retain a large amount of solution S in a comparatively small profile extending from a mounting substrate.

In addition to thermoplastics, an inventive reservoir 12 is readily formed of other materials illustratively including glass.

The reservoir 12 of the dispenser 10 is secured to a substrate through the use of a mounting bracket 18. The mounting bracket 18 has an outer surface adapted to secure to a wall or other surface proximal to a toilet paper dispenser. Other surfaces illustratively include a toilet tank and a toilet paper dispenser housing. The bracket 18 is secured to a substrate through conventional fasteners such as screws. It is appreciated that predrilled through holes in the bracket 18 facilitate the use of fasteners to secure the bracket 18 to a substrate. The inner surface 24 of the bracket 18 is shaped to form a pair of opposing channels 24 and 24' that are adapted to retain a tongue 26 extending from the reservoir 12. Preferably, a retaining ledge 28 forms the descending terminus of the bracket 18. More preferably, the tongue 26 extends parallel to the reservoir 12 for a distance greater than the height of the bracket 18 such that upon insertion of the tongue 26 into the channels 24 and 24' of the bracket 18, the weight of the reservoir 12 is partly transferred to the contact region 30 between the tongue 26 and the shoulder portion of the reservoir 12. In this way, the wallward side 17 of the reservoir 12 has a height and width greater than the height and width of the bracket 18. It is appreciated that the opposing edges of channels 24 and 24' are readily extended to form an enclosed sleeve or pocket that is also operative herein. An inventive bracket is formed from a variety of materials conventional to the art illustratively including aluminum, steel, injection moldable thermoplastics, and wood.

In a preferred mode of operation, a user of the present invention detaches a portion of disposable paper from the holder H and places the paper sheet beneath the dispenser valve 14 with one hand while the other hand, forearm, or elbow presses on the dispenser 10 to release solution S onto the positioned paper sheet. The paper sheet is then used to wipe a germ coated substrate or a body portion. Thereafter, the paper sheet is preferably discarded. Optionally, a used paper sheet has the solution S reapplied thereto in order to perform additional cleaning functions.

While the invention has been particularly shown, described and illustrated in detail with reference to the preferred embodiments and modifications thereof, it should be understood by those skilled in the art that equivalent changes in form and detail may be made without departing from the spirit and scope of the invention as defined by the appended claims.

What is claimed is:

1. A hygienic dispenser for a solution comprising:

a reservoir having a wallward side, a neck, and a top opening;

a tongue extending along the wallward side and coupled to the neck of said reservoir;

a valve adapted to seal against the opening;

a pressure actuator in mechanical communication with said valve to discharge said solution onto toilet paper; and a mounting fixture adapted to secure to a wall substrate, said fixture adapted to retain said tongue independent of a dispenser for said toilet paper.

2. The dispenser of claim 1 wherein said reservoir has a rectangular cross section.

3. The dispenser of claim 1 wherein said tongue and said reservoir form a unitary body.

4. The dispenser of claim 1 wherein said tongue is formed of sheet metal and said reservoir is formed from a thermoplastic material.

5. The dispenser of claim 1 wherein said hygienic cleaning solution comprises an active ingredient selected from the group consisting of: an alcohol and an aqueous surfactant.

6. The dispenser of claim 1 wherein said mounting fixture is secured to said substrate with an intermediate adhesive therebetween.

7. The dispenser of claim 1 wherein said fixture has opposing channels encompassing said tongue between the opposing channels.

8. The dispenser of claim 7 wherein the two opposing channels are joined to form an enclosed sleeve.

9. The dispenser of claim 1 wherein said fixture has a terminal retaining ledge.

10. The dispenser of claim 1 wherein said valve is a pump valve.

11. The dispenser of claim 1 further comprising a girdling clamp coupled to said tongue and engaging said reservoir.

12. A hygienic solution dispenser comprising:

a reservoir for solution, said reservoir having a rectangular cross section, an opening, a neck, and an integral tongue extending from the neck along a side thereof;

a valve adapted to seal against the opening;

a pressure actuator in mechanical communication with said valve to discharge said solution onto toilet paper; and a mounting fixture adapted to secure to a substrate, said fixture having opposing channels adapted to retain the tongue therebetween independent of a dispenser for said toilet paper.

13. The dispenser of claim 12 wherein said mounting fixture is secured to said substrate with an intermediate adhesive therebetween.

14. The dispenser of claim 12 wherein the two opposing channels are joined to form an enclosed sleeve.

15. The dispenser of claim 12 wherein said fixture has a terminal retaining ledge.

16. The dispenser of claim 12 wherein said valve is a pump valve.

17. A The dispenser of claim 12 wherein the opening is at the top of said reservoir.

18. The dispenser of claim 12 wherein said substrate is a wall.

* * * * *